US007370914B2

(12) United States Patent
Newman

(10) Patent No.: US 7,370,914 B2
(45) Date of Patent: May 13, 2008

(54) COMPACTLY FOLDABLE WINGBACK CHAIR

(76) Inventor: Duncan Newman, 314 Kenilworth Ave., Toronto (CA) M4L 2R6

( * ) Notice: Subject to any disclaimer, the term of this patent is extended or adjusted under 35 U.S.C. 154(b) by 0 days.

(21) Appl. No.: 11/281,558

(22) Filed: Nov. 18, 2005

(65) Prior Publication Data

US 2007/0114830 A1 May 24, 2007

(51) Int. Cl.
*A47C 7/00* (2006.01)

(52) U.S. Cl. ..... 297/440.1; 297/350; 297/440.14; 297/354.11

(58) Field of Classification Search ..... 297/378.1, 297/354.11, 440.1, 440.14, 350
See application file for complete search history.

(56) References Cited

U.S. PATENT DOCUMENTS 2,531,045 A * 11/1950 Hoffman ..... 297/117
2,660,228 A * 11/1953 Reinhold ..... 297/440.1
3,001,822 A * 9/1961 Pagliaro et al. ..... 297/381
4,697,847 A * 10/1987 Herschlag ..... 297/440.1
6,637,812 B2 * 10/2003 Laughlin et al. ..... 297/36

* cited by examiner

*Primary Examiner*—David Dunn
*Assistant Examiner*—Erika Garrett
(74) *Attorney, Agent, or Firm*—Dowell & Dowell, P.C.

(57) ABSTRACT

A collapsible wingback chair that includes a seat base portion and to which is secured a lower portion of a pair of side wings that include upper portions that are movable relative to a chair back that is pivotally mounted so as to be movable between an upright position when the chair is in use to a folded position in overlaying relationship with the base with the upper portions of the side wings also being folded relative to the base to thereby form a compact configuration for handling, shipping and storage. The side wings are selectively secured to the chair back when the back is in a raised position to thereby permit use of the chair in a conventional manner.

12 Claims, 2 Drawing Sheets

COMPACTLY FOLDABLE WINGBACK CHAIR

BACKGROUND OF THE INVENTION

1. Field of the Invention

This invention is directed to folding chairs and more particularly to wingback style chairs that have folding backs and side wings that permit the chairs to be quickly and easily folded into compact units for shipping and storage and that are readily erected for conventional use.

2. Brief Description of the Related Art

Wingback style chairs are very popular not only for home use but also for business or commercial use, such as in offices, hotels and motels. Wingback chairs are characterized by having a pair of side wings or panels that extend forward of and on opposite sides of the backs of the chairs and upwardly from side arm rests so as to be generally flush with the upper side portions of the backs of the chairs. The side wings were originally provided to reduce drafts across individuals seated in the chairs. Today, the wings serve as head rests or supports that permit individuals to rest or sleep comfortably while seated within the chairs.

A major problem associated with wingback chairs is their size and bulk which is greater than conventional non-wingback style chairs. Because of their size, the cost to ship wingback chairs from a manufacturer to a sales outlet or to an ultimate consumer is increased as fewer numbers of chairs may be loaded into conventional trailers, shipping containers and the like. Further, the amount of storage space required to store wingback chairs for sale is similarly increased, thus adding additional costs that reduce manufactures profit margins or costs that are ultimately passed to consumers.

In view of the foregoing, there is a need to improve upon the design and construction characteristics of wingback style chairs in order to reduce shipping, handling and storage costs and thereby reduce costs to manufacturers and also to reduce sales prices to consumers.

SUMMARY OF THE INVENTION

The present invention is directed to compactly folding or collapsible wingback style chairs that have backs that are pivotal relative to the bases of the chairs so that the backs may be selectively pivoted into overlaying relationship with the bases and the seats of the chairs when disconnected from side wings of the chairs. In preferred embodiments, the side wings have upper portions that are mounted by hinges to lower fixed portions. The upper portions are normally secured by removable fasteners to the upper opposite side portions of the backs of the chairs so that the side wings are in an erect configuration for conventional use. However, upon removal of the fasteners, the side wings are pivotal initially outwardly relative to the backs of the chairs and subsequently pivoted or folded inwardly so as to be folded over the folded backs of the chairs. In this manner, the chair backs and the side wings are compactly positioned closely to the seats of the chairs and such that the chair backs generally do not extend significantly above the arm rests of the chairs when folded.

To further reduce the size and/or bulk of the chairs for storage and/or shipment, the legs of the chairs are removably mounted to the underside of the seat bases of the chairs.

In a preferred embodiment of the invention, each side wing of each wingback chair includes at least one projection or ear that extends outwardly from an upper and inner surface thereof that is of a size to be cooperatively received and seated within an opening or recess in the upper portion of the adjacent side of the pivotally movable back of the chair. A threaded opening or hole in the projection or ear aligns with a non-threaded opening or hole through an outer frame of the chair back for selectively receiving a threaded fastener, such as an enlarged screw. When the side wings are fastened to the back of the chair by the screws engaging the projections or ears of the side wings, the chair functions as a conventional wingback chair. To fold the chair to a compact configuration, the fasteners are disengaged from the projections or ears and the back and side wings may thereafter be folded. Other types of fasteners may be used with other mechanical elements used to detachably secure the side wings relative to the back of the chair. In some embodiments, the recesses may be provided on the side wings and the projections on the sides of the chair back.

It is a primary object of the present invention to provide wingback style chairs that include at least foldable side wings and backs such that the chairs may be selectively erected into a configuration for conventional use or compactly folded to facilitate shipping and storage.

It is also an object of the invention to reduce wingback chair manufactures' handling and shipping costs to thereby obtain possible increases in manufacturing profits and/or to reduce consumer costs.

It is another object of the invention to facilitate the moving and handling of wingback style chairs by allowing the chairs to be folded into compact configurations that are easier to manually manipulate such as through doorways and other access openings in homes, offices and other buildings.

BRIEF DESCRIPTION OF THE DRAWINGS

A better understanding of the invention will be had with reference to the accompanying drawings wherein.

DESCRIPTION OF THE PREFERRED EMBODIMENT

Figure 1:
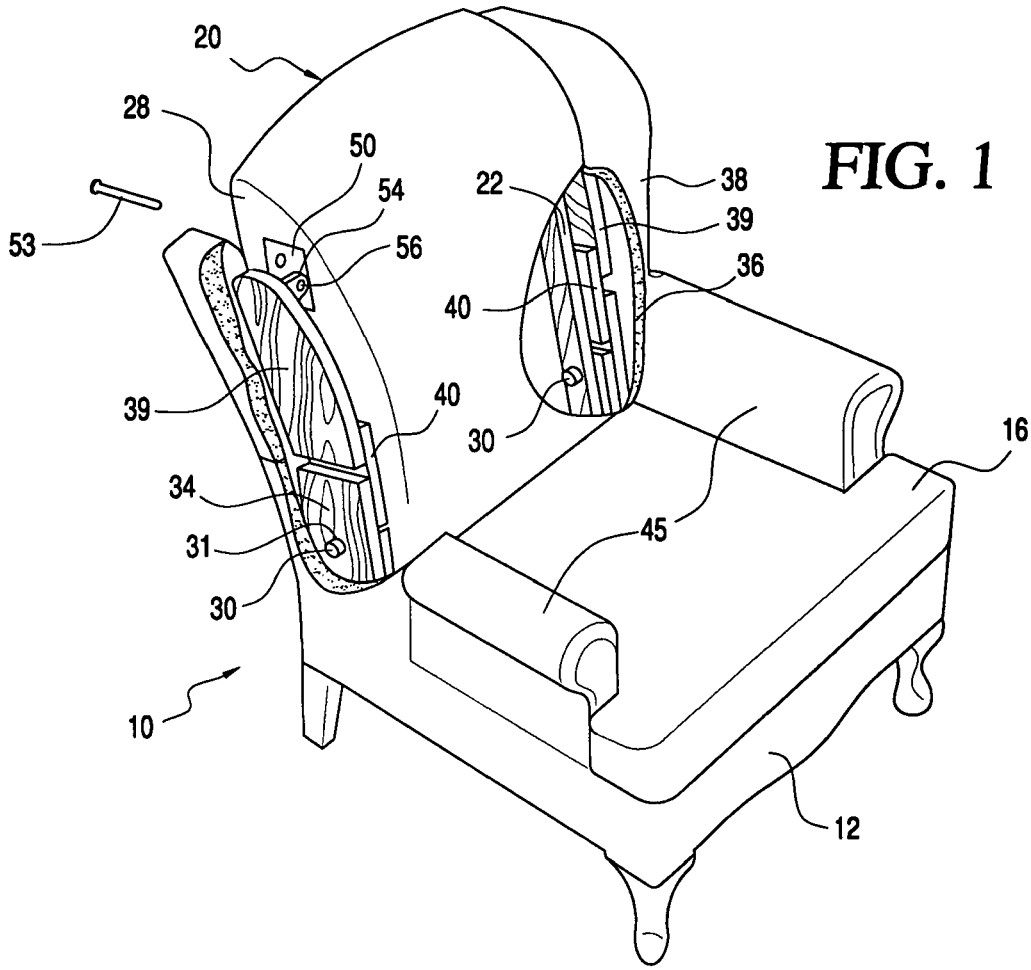
FIG. 1 is a front perspective view of a compactly foldable wingback style chair shown substantially erected and with portions broken away to show hinge and locking elements associated with the back and side wings of the chair.
Figure 4:
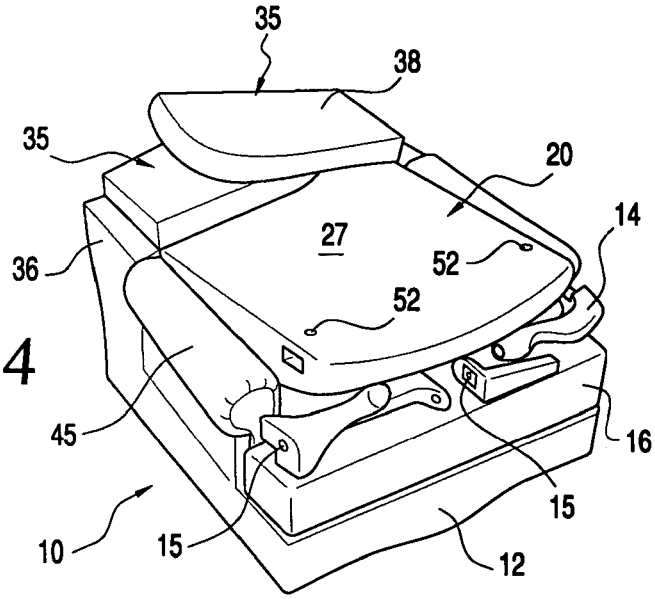
FIG. 4 is a front perspective view of the chair of FIG. 1 compactly folded and with the chair legs removed.
Figure 5:
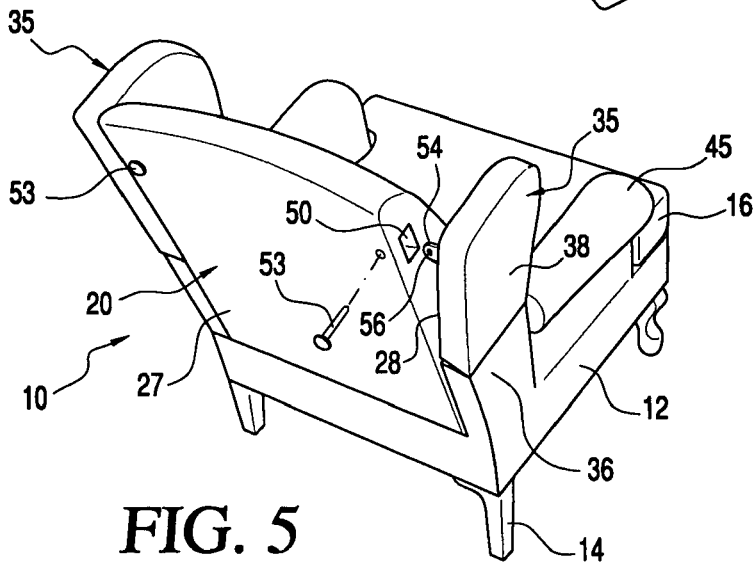
FIG. 5 is a rear perspective view illustrating one embodiment for securing the chair back to one of the side wings of the chair.

With continued reference to the drawing figures, a wingback style chair 10 is shown that may be erected for conventional use, substantially as shown if FIGS. 1 and 5, or compactly folded to facilitate handling, shipping and storage, substantially as shown in FIG. 4. The chair includes a base 12 that conventionally is defined by a reinforced frame that is covered or upholstered with padding and a covering material that may be any conventional chair covering including fabrics, leathers, plastic laminates and the like. The base is supported by a plurality of legs 14, each of which is preferably removably mounted to the underside of the base.

In FIG. 4, the legs are shown including threaded sockets 15 for receiving threaded fasteners associated with the base of the chair. In some embodiments, the base of the chair may include the threaded sockets and the legs may be provided with fastening screws. Any type of conventional leg attachment structures may be used to removably mount the legs 14 to the base of the chair.

Figure 2:
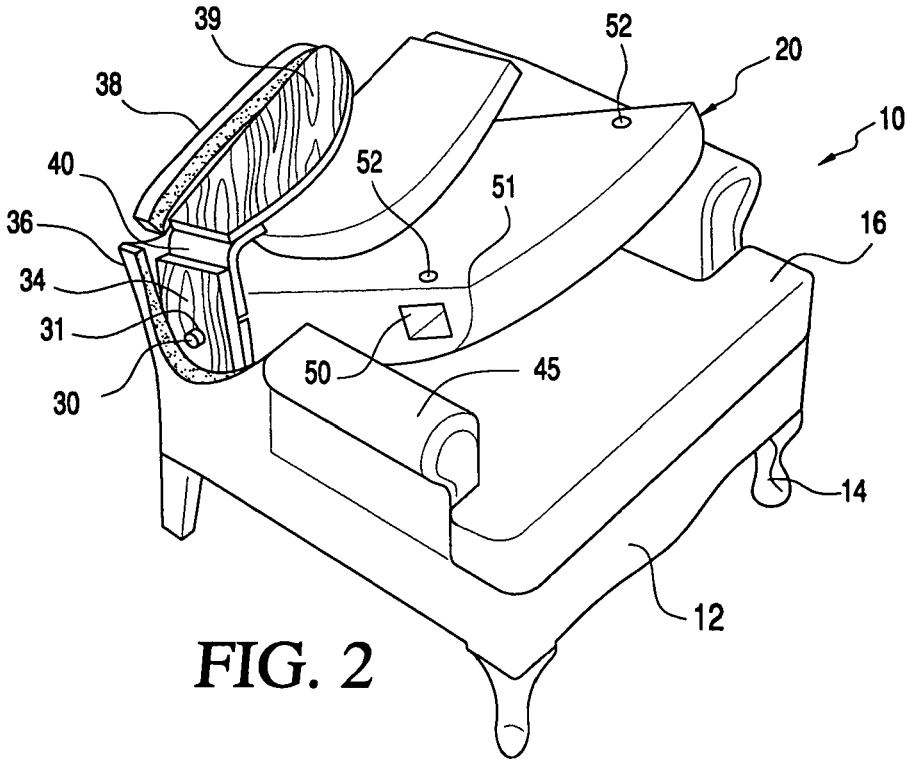
FIG. 2 is a front perspective view similar to FIG. 1 showing the chair back and side wings being folded to a compact configuration.

A seat member or cushion 16 is supported on the base 12 and may be fixed in place or removable, as desired. A chair back 20 that includes an inner rigid and preferably reinforced frame 22, see FIG. 1, is covered by conventional upholstery materials that enclose interior padding and/or spring elements, not shown. The back is pivotally mounted relative to the seat and base of the chair. The chair back includes a front portion 26, rear portion 27 and opposite sides 28. A pair of pivot pins 30 extend from lower portions of opposite sides of the frame 22, as shown in FIGS. 1 and 2, into and through aligned openings 31 in lower inner frame portions 34 of a pair of side wings 35 of the chair. Each side wing includes a lower fixed portion 36 and an upper pivotal portion 38. The lower inner frame portions 34 are rigidly secured to the chair base 12 while upper inner frame portions 39 of the upper pivotal portions 38 of the side wings are hingedly connected to the lower fixed frame portions 34 at a vertical elevation that is substantially equal to the height of the adjacent armrests 45 of the chair. The hinges 40 shown in the drawings are living hinges formed of a pliable or bendable plastic or other material that are secured to both the fixed lower frame portions 34 and the upper inner frame portions 39 by suitable fasteners or adhesives.

The side wings 35 may be covered with conventional upholstery including padding and/or covering materials. To promote an ease of pivotal movement between the chair back and the side wings, friction reducing bearing sleeves, not shown, may be provided within the openings or holes 31 formed in the fixed inner frame portions 34 of the side wings 35 in which the pivot pins 30 may be received. In some embodiments, the pivot pins 30 may be fixedly mounted to the fixed lower frames of the side wings and pivotally mounted within openings in the sides of the chair backs.

As opposed to using a living hinge, other conventional hinges may be used to pivotally mount the upper and lower portions of the side wings together.

As previously noted, the upper portions 38 of the side wings 35 are pivotal relative to the back of the chair. The upper portions also serve to anchor the back in an erect position for conventional use of the wingback chair. Although there are various ways to selectively connect and disconnect the back and the side wings to one another, in the embodiment shown in the drawings, the back is provided with a recess 50 in each of the sides thereof and adjacent an upper portion 51 of the chair back. Openings 52 are provided through the chair back and its inner frame 22 that communicated with the recesses 50 and are of a size to cooperatively receive assembly screws or other fasteners 53 therein.

Figure 3:
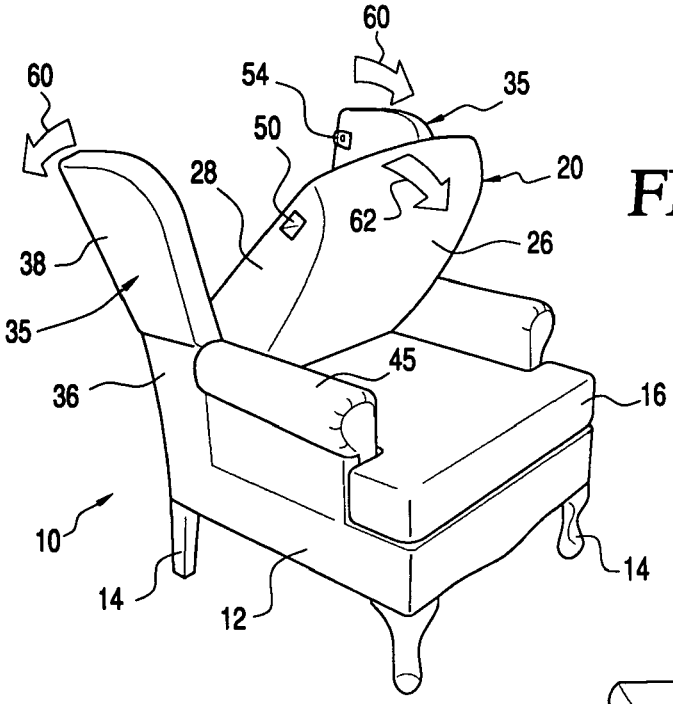
FIG. 3 is a front perspective illustrational view of the chair of FIG. 1 showing the pivotal motions of the back and side wings of the chair to collapse the chair from the erected position of FIG. 1 to the folded position of FIGS. 2 and 4.

Each side wing includes a locking projection or ear 54 that extends inwardly towards an adjacent side of the chair back from an upper and inner surface of each movable upper portion 38 thereof as shown in FIGS. 3 and 5. The projections are of a size to be cooperatively received and seated within the recesses 50 of the adjacent side of the chair back as the chair is being erected or assembled for use. Each projection includes a threaded opening 56 for receiving a threaded end of one of the screws 53 therein. After the side wings are pivoted to their upper raised positions, the screws are used to secure the back to the side wings.

In some embodiments, the recesses 50 may be provided in the upper portions of the side wings with the projections 54 extending from the sides of the chair back, although this structure is not preferred.

When it is desired to collapse the chair to a compact configuration for handling, shipping or storage, the screws 53 are removed from the locking projections 54. The side wings 35 are then pivoted outwardly relative to the chair back 20 as shown by the arrows 60 in FIG. 3 to permit the back to be folded into overlaying position with the seat and chair base as shown by the arrow 62 wherein the back is substantially coplanar with the upper portions of the armrests 45, as shown in FIG. 4. The side wings are thereafter folded over one another and the chair back as shown in FIG. 4. In some instances, the seat cushion may be removed and placed over the folded back for compact handling, shipping and/or storage. The legs are also removed and the chair is thus in a very compact configuration that permits at least two chairs to be boxed, crated or stored in a volume that would normally house only a single chair. The assembly of the chair is accomplished utilizing reverse steps.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

I claim:

1. A foldable wingback chair including a base, a seat supported on said base, a back having opposite sides, pivot means for pivotally connecting said back relative to said base so as to be selectively movable between an upright erected position and a folded position overlaying at least said base, a pair of side wings, each of said side wings including a fixed lower portion that is secured relative to said base and a movable upper portion that is pivotally connected to said lower portion such that said upper portion is selectively movable so as to be folded with respect to said base and with respect to said back, said pivot means being mounted between said opposite sides of said back and said fixed lower portions of said side wings, and securing means for selectively securing said upper portions of said side wings to said back when said back is in the upright position whereby when said back is not secured to said side wings said back may be compactly folded relative to at least said base and said side wings may also be folded relative to at least said base so that the wingback chair is compactly configured.

2. The wingback chair of claim 1 including a plurality of legs for supporting said base.

3. The wingback chair of claim 1 including a living hinge for pivotally connecting said movable upper portions of said side wings to said fixed lower portions.

4. The wingback chair of claim 1 wherein said securing means includes at least one projection extending from each of one of said upper portions of said side wings and said opposing sides of said back for selectively being received is a recess in the other of said upper portions of said side wings and said opposing sides of said back, and fastening means for securing said projections within said recesses.

5. The wingback chair of claim 4 wherein said recesses are formed in said opposing sides of said back and said projections extend from said upper portions of said side wings.

6. The wingback chair of claim 4 wherein said fastening means include fasteners that are extendable through holes communicating with said recesses.

7. The wingback chair of claim 6 wherein said legs are removably mounted to said base.

8. The wingback chair of claim 4 wherein said legs are removably mounted to said base.

9. The wingback chair of claim 1 wherein said securing means includes at least one projection extending from each of said movable upper portions of said side wings that are selectively receivable within recesses in said opposite sides of said back, and fastening means for securing said projections within said recesses.

10. The wingback chair of claim 9 wherein said fastening means include fasteners that are extendable through holes communicating with said recesses.

11. The wingback chair of claim 9 including a plurality of legs removably mounted to said base.

12. A foldable wingback chair including a base, a plurality of removable legs for supporting said base, a seat supported on said base, a back having opposite sides, pivot means for pivotally connecting said back relative to said base so as to be selectively movable between an upright erected position and a folded position overlaying at least said base, a pair of side wings selectively movable toward and away from said opposite sides of said back, said side wings being mounted adjacent armrests that extend upwardly along opposite sides of said seat, and securing means for selectively securing said side wings to said back when said back is in the upright position whereby when said back is not secured to said side wings said back may be compactly folded relative to at least said base and said side wings may also be folded relative to at least said base so that the wingback chair is compactly configured.

* * * * *